US007594654B2

(12) United States Patent
Matsumoto

(10) Patent No.: US 7,594,654 B2
(45) Date of Patent: Sep. 29, 2009

(54) SHEET CONVEYOR AND IMAGE FORMATION DEVICE WITH SHAPED BELT PLATEN

(75) Inventor: Tadashi Matsumoto, Adachi-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 510 days.

(21) Appl. No.: 11/418,406

(22) Filed: May 4, 2006

(65) Prior Publication Data

US 2006/0261298 A1 Nov. 23, 2006

(30) Foreign Application Priority Data

May 17, 2005 (JP) ..... 2005-143542

(51) Int. Cl.
*B65H 29/30* (2006.01)

(52) U.S. Cl. ..... 271/193; 271/275; 271/901; 198/690.1; 198/619

(58) Field of Classification Search ..... 271/275, 271/193, 901; 198/690.1, 619, 841; 347/104; 399/303
See application file for complete search history.

(56) References Cited

U.S. PATENT DOCUMENTS 4,480,742 A * 11/1984 Muylle ..... 198/689.1
2004/0164482 A1* 8/2004 Edinger ..... 271/197

FOREIGN PATENT DOCUMENTS

JP 2000-060168 A 2/2000
JP 2000-247476 A 9/2000
JP 2000247476 A * 9/2000

* cited by examiner

*Primary Examiner*—Patrick H Mackey
*Assistant Examiner*—Gerald W McClain
(74) *Attorney, Agent, or Firm*—Canon USA Inc IP Div

(57) ABSTRACT

A sheet conveyor includes a conveyor belt that conveys a sheet material while holding the sheet material by attraction with an electric force, and a platen that slidably supports a bottom surface of the conveyor belt so as to maintain flatness of a predetermined region of the conveyor belt. In response to the electric force, an attractive force for attracting the conveyor belt to the platen is generated. The platen is shaped such that a surface of the platen that is in contact with the conveyor belt has a width that increases gradually from an upstream side of the platen towards a downstream side thereof in a conveying direction of the conveyor belt.

13 Claims, 10 Drawing Sheets

SHEET CONVEYOR AND IMAGE FORMATION DEVICE WITH SHAPED BELT PLATEN

BACKGROUND OF THE INVENTION

1. Field of the Invention

The present invention relates to a sheet conveyor having a conveyor belt that conveys a sheet material while holding the sheet material by attraction with an electric force, and to an image formation device equipped with such a sheet conveyor.

2. Description of the Related Art

Generally, image formation devices, such as printers, copiers, and facsimiles, form images of dot patterns on sheet materials (recording media), such as paper and thin plastic sheets, on the basis of image information. There are various recording types of image formation devices, some of which are, for example, an inkjet type, a wire-dot type, a thermal type, and a laser-beam emission type. In an inkjet type, an image is formed by discharging ink towards a sheet material, such as recording paper, from a recording head. An inkjet image formation device is characterized in having a compact recording head, having the capability to record high-resolution images at high speed, and requiring low operating costs. Furthermore, due to performing a recording operation in a non-impact fashion, an inkjet image formation device does not produce much noise. Moreover, an inkjet image formation device is also advantageous in having an ability to record color images readily using multiple colors. Of image formation devices of inkjet types, a full-line recording device equipped with a line-type recording head having a plurality of discharge nozzles arranged in a width direction of a sheet material achieves higher speed for recording.

In an image formation device, a sheet material fed from a paper-feeder unit, such as a cassette, has to be conveyed through an image-forming unit (recording unit) and then to a paper-ejector unit. In this case, the conveying operation for the sheet material is constantly controlled at a predetermined timing for the feeding step, the image formation step, and the ejection step. The conveying process from the feeding step to the image formation step especially requires accuracy since it directly affects the image forming position on the sheet material. Furthermore, if the conveying speed of the sheet material is not constant during the image formation step, the magnification of the image may vary, causing the image to expand or contract. Especially in an image formation device equipped with a plurality of recording heads for multiple colors, the images recorded by the recording heads (image-forming units) may become misaligned with one another. In a color image formation device, such misalignment will directly lead to color misalignment, resulting in a defective image. In order to prevent this, it is necessary to properly transmit a conveying force to the sheet material from a conveying unit that is controlled with high precision.

In view of these circumstances, a sheet conveyor having an endless belt is disclosed in which the endless belt conveys a sheet material while holding the sheet material securely by electrostatic attraction. If such a belt-type sheet conveyor that applies electrostatic attraction is used in, for example, a color image formation device equipped with a plurality of recording heads (image-forming unit), the conveying speed of the belt must be maintained precisely so that the image forming position of each recording head is accurate. In addition, the sheet material must be securely attached to a conveying member (such as a belt or a drum) so as to prevent the sheet material from being displaced or from floating.

However, in an image formation device having a plurality of full-line recording heads extending longitudinally in a direction crosswise to the conveying direction, such as a color image formation device, the recording head at the uppermost-stream position and the recording head at the lowermost-stream position in the conveying direction are separated from each other by a large distance. This can lead to flapping of the sheet material in the recording region, thus causing, for example, blurred images or paper jams. In a known technique for restricting a sheet material from floating, the sheet material is biased downward by means of electrodes provided in a conveyor belt. In detail, a voltage is applied to the electrodes to produce an electric force, by which the sheet material is attracted to the conveyor belt. Furthermore, a technique for attracting a sheet material to a conveyor belt by static electrification is also known. Moreover, in another known technique, a pressure control chamber is provided, and a fan is used to control the pressure so as to attract a sheet material to a conveyor belt by suction.

In a sheet conveyor that attracts a sheet material to a conveyor belt with an electrostatic force generated by applying an electric charge to electrodes (attraction-generating unit) provided in the conveyor belt as mentioned above, the sheet material fed from the paper-feeder unit is conveyed to the recording region of the recording heads while being attracted to the conveyor belt by the attraction-generating unit (i.e. the conductive electrodes). In the recording region, the recording heads form images on the sheet material. A typical structure of such a sheet conveyor is discussed in Japanese Patent Laid-Open Nos. 2000-247476 and 2000-60168.

Such related art has technical problems to be solved, which will be described below. FIG. 11 schematically illustrates the disadvantages in the sheet conveyor having the conveyor belt of the related art. With respect to image formation devices that hold a sheet material by electrostatic attraction and perform a non-contact recording operation as in an inkjet recording type, the technology for high-resolution recording is rapidly developing due to high-density packaging of recording heads. On the other hand, the dimension of recording heads is also increasing. Moreover, an improvement in gradation by increasing the installation number of recording heads is also in demand. Therefore, the flatness accuracy of sheet materials serving as recording media needs to be maintained not only in a region directly below each recording head but also over a wide region.

However, in the related art as shown in FIG. 11, if a platen that faces the recording heads is increased dimensionally in the conveying direction, the conveyor belt wound around the rollers with a certain tension undulates in a direction crosswise to the conveying direction. When the undulated conveyor belt slides on the platen, the undulation may cause air to enter the space between the two even if the conveyor belt is attached to the platen by means of an attractive force produced therebetween. This creates unattached sections in the conveyor belt, causing the conveyor belt to swell. Although such swelling of the conveyor belt can be reduced by lowering the tension, it is difficult to achieve high-accuracy conveying in that case since the conveyor belt may be subject to slipping against the rollers.

SUMMARY OF THE INVENTION

The present invention is directed to a sheet conveyor that allows a conveyor belt to be attached securely to a platen by attraction without having air in between and that conveys a sheet material with high accuracy by maintaining flatness of a predetermined surface area of the conveyor belt. The present invention also provides an image formation device equipped with such a sheet conveyor.

According to an aspect of the present invention, a sheet conveyer is provided, which includes a conveyor belt configured to convey a sheet material while holding the sheet material by attraction with an electric force, and a platen that slidably supports a bottom surface of the conveyor belt so as to maintain flatness of a predetermined region of the conveyor belt. In response to the electric force, an attractive force for attracting the conveyor belt to the platen is generated. The platen is shaped such that a surface of the platen that is in contact with the conveyor belt has a width that increases gradually from an upstream side of the platen towards a downstream side thereof in a conveying direction of the conveyor belt.

According to the above-referenced aspect of the present invention, the upstream side of the platen is shaped such that the sliding area between the conveyor belt and the platen becomes larger gradually in the conveying direction of the conveyor belt. According to this shape, the conveyor belt is properly attached to the platen by attraction without having air in between. Thus, the flatness accuracy of a predetermined surface area of the conveyor belt is properly maintained so that the sheet material is conveyed with high accuracy. Accordingly, the present invention provides a sheet conveyor and an image formation device that achieve a reduced distance between the sheet material and a recording head assembly for high-resolution image formation.

Further features of the present invention will become apparent from the following description of exemplary embodiments.

DESCRIPTION OF THE EMBODIMENTS

Figure 1:
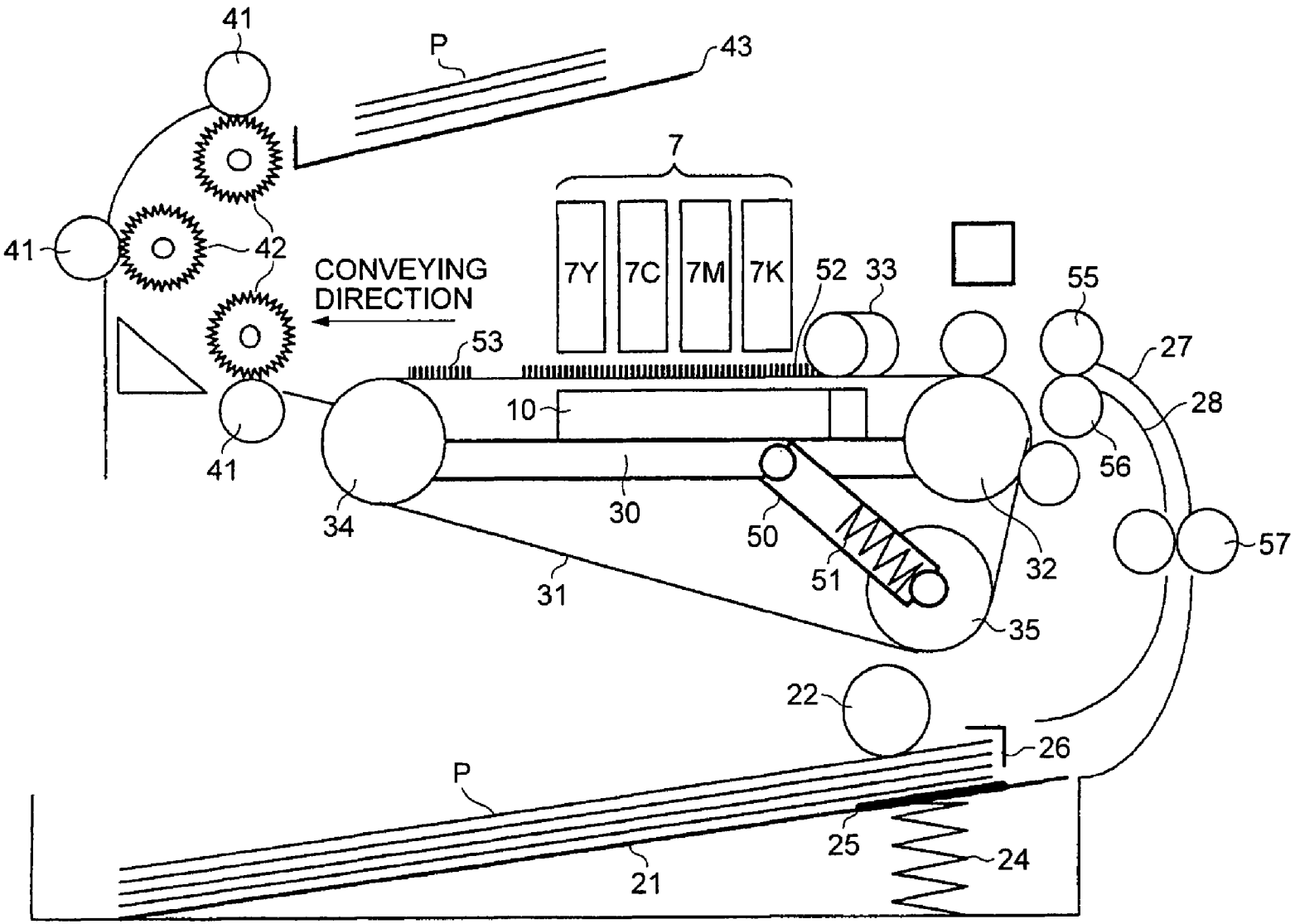
FIG. 1 is a vertical sectional view of an image formation device equipped with a sheet conveyor according to an exemplary embodiment of the present invention.
Figure 2:
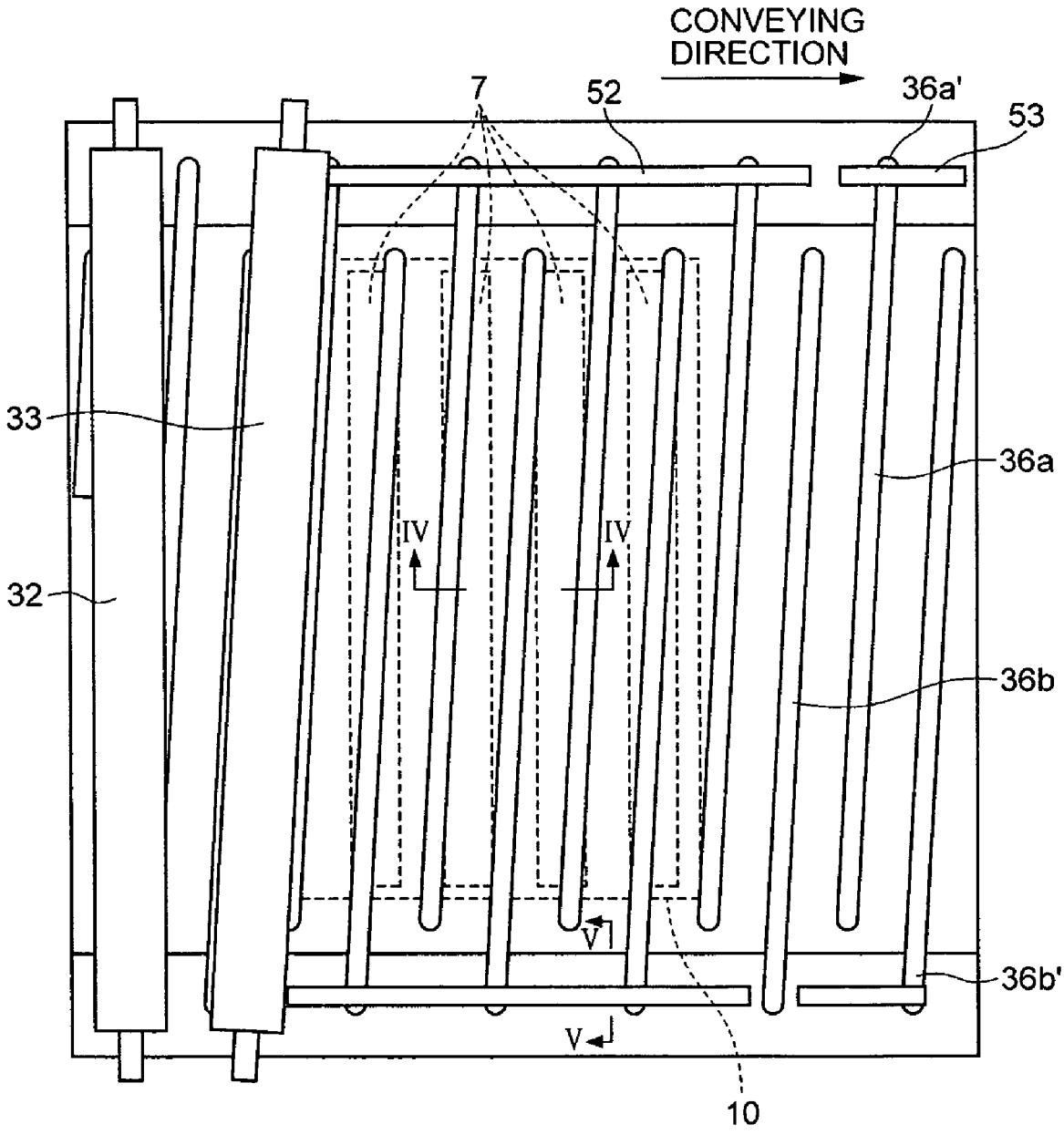
FIG. 2 is a plan view of the sheet conveyor according to an exemplary embodiment of the present invention.
Figure 3:
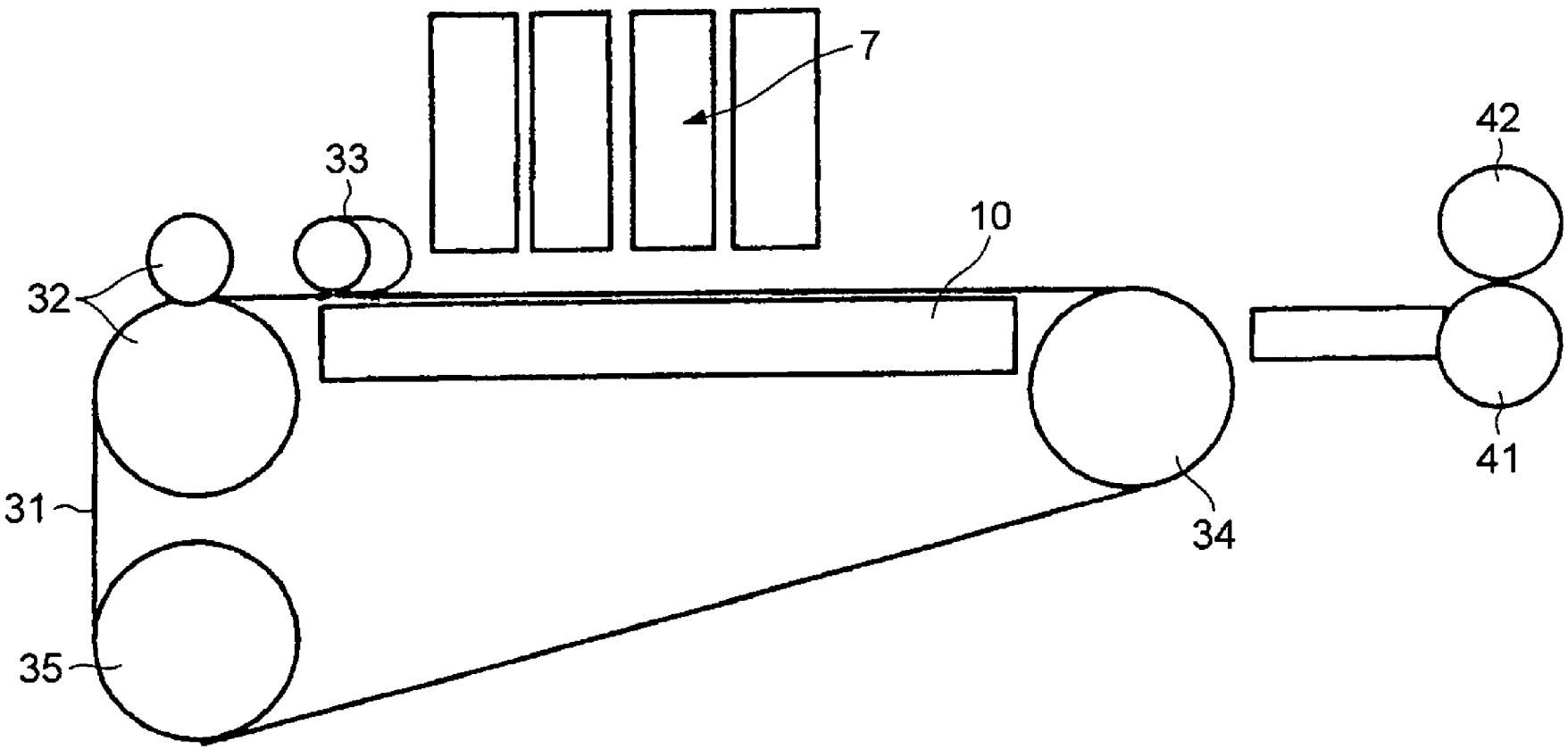
FIG. 3 is a side view of the sheet conveyor shown in FIG. 2.

Embodiments of the present invention will now be described with reference to the drawings. Similar reference numerals and letters refer to similar items in the following figures. FIG. 1 is a vertical sectional view of an image formation device equipped with a sheet conveyor according to an exemplary embodiment of the present invention. FIG. 2 is a plan view of the sheet conveyor according to an exemplary embodiment of the present invention. FIG. 3 is a side view of the sheet conveyor shown in FIG. 2.

The structure and operation of the image formation device equipped with the sheet conveyor according to the exemplary embodiment of the present invention will now be described with reference to FIGS. 1 to 3. The exemplary embodiment described below is directed to an inkjet-type image formation device in which a recording head discharges ink towards a sheet material to form an image thereon. In FIG. 1, a paper-feeder unit drives a pressure plate 21, which holds sheets P serving as recording media, and a rotating member 22, which feeds each sheet P, so as to start a paper-feeding operation. The pressure plate 21 is tiltable around a tilt axis and is biased towards the rotating member 22 by a spring 24.

A section of the pressure plate 21 that faces the rotating member 22 is provided with a separating pad 25 formed of a material having a high coefficient of friction, such as artificial leather, so as to prevent overfeeding of the sheets P. A separating claw 26 for separating the sheets P in a one-by-one fashion is provided in a manner such that the separating claw 26 covers one of edges of the stack of sheets P. Although not shown, a release cam is provided for allowing the pressure plate 21 to move towards and away from the rotating member 22. In a standby state, the release cam pushes the pressure plate 21 to a predetermined position so that the pressure plate 21 and the sheets P disposed thereon are positioned distant from the rotating member 22.

When the rotating member 22 and the release cam are driven, the release cam moves away from the pressure plate 21 so that the pressure plate 21 is lifted upward. This allows the sheets P to come into contact with the rotating member 22. In response to rotation of the rotating member 22, one of the sheets P is picked up and separated from the stack by the separating claw 26. The separated sheet P is nipped by a pair of conveying rollers 57 and is guided towards a conveyor-belt unit through an upper guide 27 and a lower guide 28. A pair of correction rollers 55, 56 for correcting the skew of the sheet P is disposed in front of the conveyor-belt unit. The skew of the sheet P being conveyed is corrected by pushing the leading end of the sheet P into a nip between the correction rollers 55, 56. Subsequently, the sheet P is sent to the conveyor-belt unit at a predetermined timing. The rotating member 22 rotates until the sheet P reaches the conveyor-belt unit. When the stack of sheets P is moved back to the standby position so as to be distant from the rotating member 22, the driving power for the rotating member 22 is cut off.

The conveyor-belt unit defines the sheet conveyor according to the exemplary embodiment and includes a conveyor belt 31 that conveys the sheet P while holding the sheet P by attraction. The conveyor belt 31 is driven by a driving roller 34 and is wound around a conveying roller 32, functioning as a driven roller, and a pressure roller 35 functioning as a tension roller. The conveying roller 32 and the driving roller 34 are rotatably attached to a frame 30. The pressure roller 35 is rotatably attached to one end of an arm 50, and the other end of the arm 50 is rockably attached to the frame 30. The pressure roller 35 is biased outward by a spring 51 so that a predetermined tension is applied to the conveyor belt 31.

The conveyor belt 31 is formed of an endless belt. A recording head assembly 7 for forming an image on the sheet P is disposed above a flat portion of the conveyor belt 31. A platen 10 is disposed at a position facing the recording head assembly 7 across the conveyor belt 31. The platen 10 is positioned below the conveyor belt 31 and is urged against a reference position member (not shown) of the recording head assembly 7 in a contact fashion so as to be maintained in position with high accuracy. Thus, the platen 10 accurately guides the conveyor belt 31 while restricting a downward movement of the conveyor belt 31. In this exemplary embodiment, the recording head assembly 7 functioning as an image-forming unit is a color recordable type and includes four recording heads 7K, 7M, 7C, and 7Y for four colors, which are black (K), magenta (M), cyan (C), and yellow (Y), respectively.

A pressing roller 33 for pressing the sheet P against the conveyor belt 31 is disposed at a position downstream of the conveying roller 32 in the conveying direction. The pressing roller 33 is rotated in response to the driving of the conveyor belt 31 and presses the conveyed sheet P against the top surface of the conveyor belt 31 at a starting position for attraction. Moreover, the pressing roller 33 is biased by a spring (not shown) so as to be in pressure-contact with the conveyor belt 31, and guides the sheet P towards the recording head assembly 7 by rotating in response to the driving of the conveyor belt 31.

The pair of correction rollers 55, 56 is disposed in front of the conveyor belt 31 on the conveying path of the sheet P, or more specifically, at a position upstream of the conveying roller 32. As mentioned above, the correction rollers 55, 56 are provided for correcting the skew of the leading end of the sheet P fed from the paper-feeder unit. In other words, the sheet P fed from the paper-feeder unit has its leading end straightened and is then conveyed to the conveyor belt 31 in response to a recording start signal. The leading end or trailing end of the sheet P is detected by a PE (paper-end) sensor (not shown) including a PE-sensor lever and a photo-sensor. The recording head assembly 7 functioning as the image-forming unit for forming an image on the sheet P on the basis of image information is disposed downstream of the conveying roller 32 in the conveying direction.

The sheet P conveyed to the conveyor-belt unit from the correction rollers 55, 56 is inserted into a nip between the pressing roller 33 and the conveyor belt 31. In this case, the PE-sensor lever detects the leading end of the conveyed sheet P so as to determine a recording position on the sheet P. The conveyor belt 31 is then driven in response to driving of the driving roller 34 with a conveying motor. Thus, the conveyor belt 31 conveys the sheet P in the left direction in FIG. 1 (in the right direction in FIGS. 2 and 3).

In FIG. 1, the recording head assembly 7 functioning as the image-forming unit is provided with the four recording heads of a line inkjet type. Specifically, each recording head has a plurality of discharge nozzles aligned in a direction crosswise to the conveying direction of the sheet P. The recording heads are supported by a head holder and include the black recording head 7K, the cyan recording head 7C, the magenta recording head 7M, and the yellow recording head 7Y arranged in that order at a predetermined interval in the conveying direction of the sheet P. Each recording head applies heat energy to ink with, for example, a heater. The heat induces film boiling of the ink, thus forming bubbles in the ink. The bubbles expand or contract so as to create a pressure change. Due to the pressure change, the ink is discharged from the discharge nozzles of each recording head, thereby forming an image on the sheet P.

The head holder is movable in the vertical direction by being supported by shafts provided with ball screws at four sections of the head holder. The head holder can be maintained at a certain height with high precision. A cap is provided for covering a discharge face of the recording head assembly 7. A driving unit (not shown) moves the cap in a parallel fashion between a capping position directly below the recording head assembly 7 and an uncapping position at which the cap is withdrawn from the recording head assembly 7. In a non-recording mode, the head holder is lifted upward and the cap is moved to the capping position directly below the recording head assembly 7 so as to cover the discharge face of the recording head assembly 7. Accordingly, the cap protects the recording head assembly 7 and prevents the ink from evaporating.

In FIG. 1, a paper-ejector unit is provided for ejecting the sheet P released from the conveyor-belt unit outward from the device. A pair of charge-removing brushes 53 functioning as a neutralizing unit for static removal is disposed along opposite edges of the conveyor belt 31 at a position downstream of the recording head assembly 7, or more specifically, at a position downstream of charging brushes 52. The sheet P conveyed through the recording head assembly 7 while being held on the top surface of the conveyor belt 31 by electrostatic attraction is subsequently sent to the charge-removing brushes 53 where the static charge is removed from the sheet P. The sheet P is then subject to curvature separation by a separator plate and is guided towards the paper-ejector unit. The paper-ejector unit includes pairs of ejection rollers 41 and spur rollers 42. In this embodiment, the paper-ejector unit includes three pairs of ejection rollers 41 and spur rollers 42. The sheet P having an image formed thereon by the recording head assembly 7 is conveyed through the nip between each pair of rollers 41 and 42 so as to be ejected to a catch tray 43. The ejection rollers 41 receive the rotational force of the driving roller 34 so as to rotate simultaneously with the driving roller 34. To prevent the ink of the image on the sheet P from being transferred to the spur rollers 42, the outer periphery of each spur roller 42 is given sharp protrusions.

Figure 4:
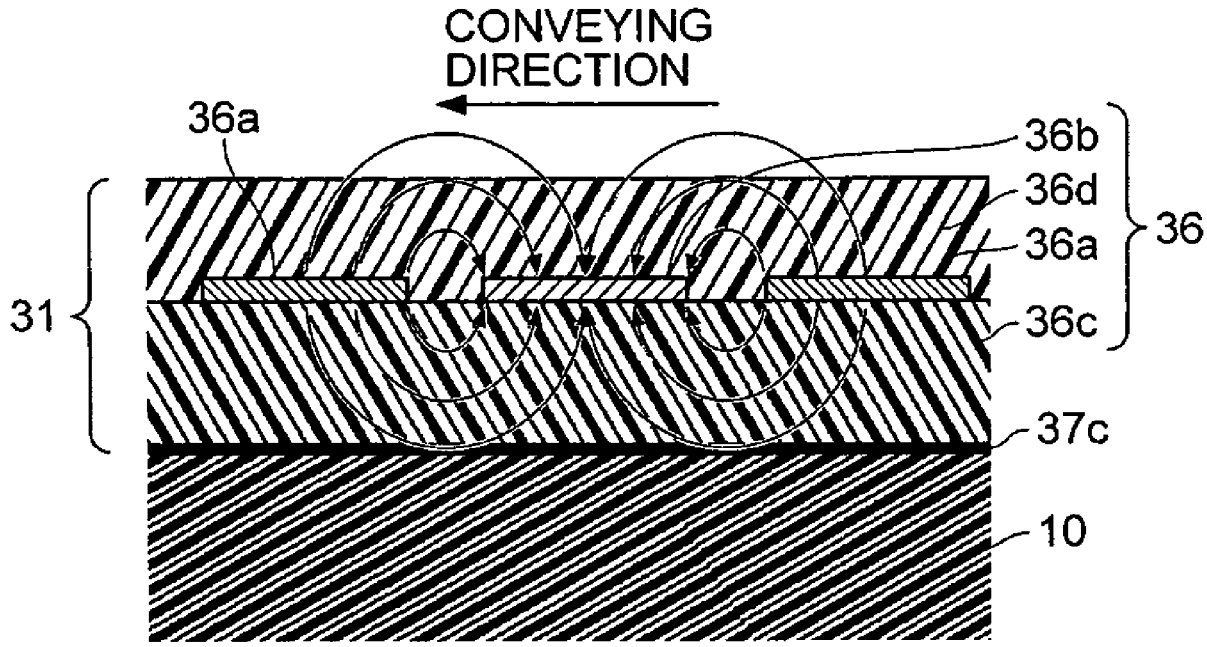
FIG. 4 is a vertical sectional view taken along line IV-IV in FIG. 2 and illustrates an attraction-generating mechanism by showing a vertical section of electrodes of a conveyor belt and a platen disposed below the electrodes taken in a conveying direction.
Figure 5:
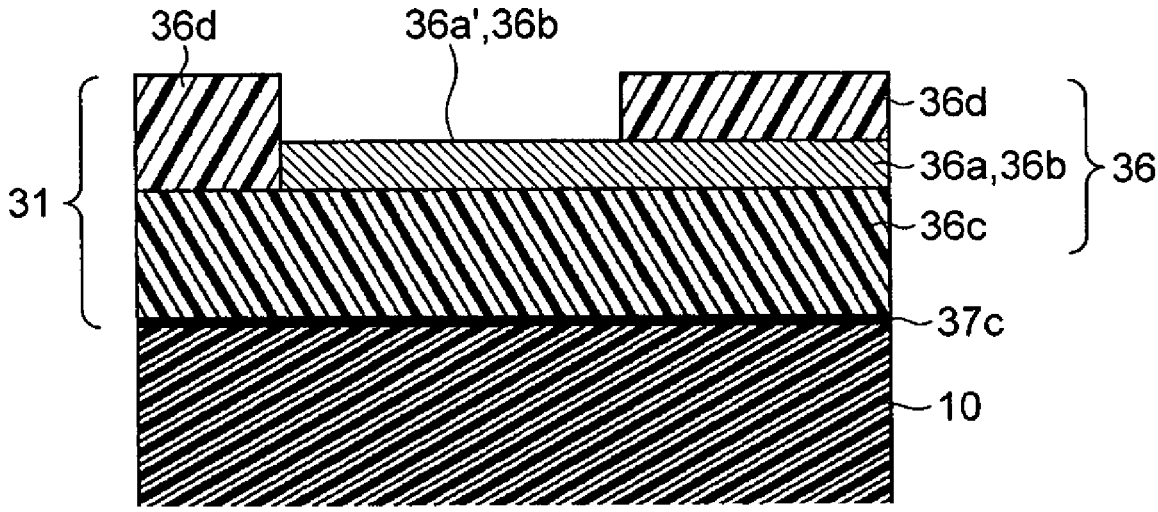
FIG. 5 is a vertical sectional view taken along line V-V in FIG. 2 and illustrates a vertical section of electrified portions of the electrodes of the conveyor belt and the platen disposed below the electrodes taken in a direction crosswise to the conveying direction.
Figure 6:
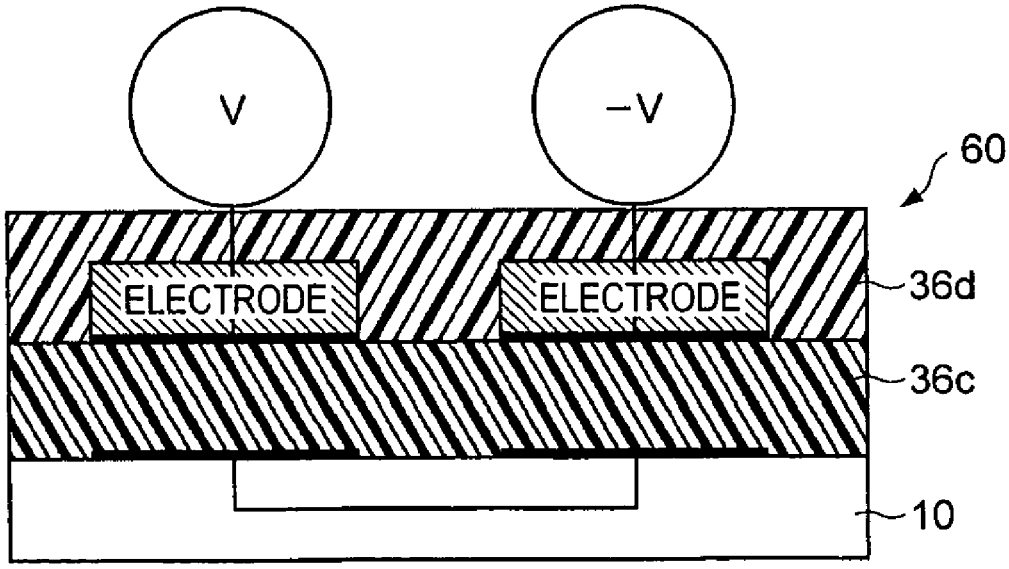
FIG. 6 schematically illustrates the relationship among an attraction-generating unit for attracting a sheet to the conveyor belt, a belt attraction unit for attracting the conveyor belt towards the platen by suction, and a power source in the sheet conveyor according to the exemplary embodiment of the present invention.

FIG. 4 is a vertical sectional view taken along line IV-IV in FIG. 2. Specifically, FIG. 4 illustrates an attraction-generating mechanism by showing a vertical section of electrodes of the conveyor belt 31 and the platen 10 disposed below the electrodes taken in the conveying direction. FIG. 5 is a vertical sectional view taken along line V-V in FIG. 2. Specifically, FIG. 5 illustrates a vertical section of electrified portions of the electrodes of the conveyor belt 31 and the platen 10 disposed below the electrodes taken in a direction crosswise to the conveying direction. FIG. 6 schematically illustrates the relationship among an attraction-generating unit 36 for attracting the sheet P to the conveyor belt 31, a belt attraction unit for attracting the conveyor belt 31 towards the platen 10 by suction, and a power source in the sheet conveyor according to the exemplary embodiment of the present invention.

Referring to FIGS. 1 to 6, the conveyor belt 31 that moves while holding the sheet P by attraction is an endless belt having a thickness of about 0.1 mm to 0.2 mm and can be composed of a synthetic resin, such as polyethylene and polycarbonate. The charging brushes 52 are connected to a high-voltage power source (not shown) that generates a predetermined high voltage. One of the charging brushes 52 that corresponds to positive electrodes 36*a* receives a positive high voltage, whereas the other charging brush 52 that corresponds to negative electrodes 36*b* receives a zero or negative voltage. The charging brushes 52 apply a voltage of about 0.5 kV to 10 kV to the attraction-generating unit 36 so that an attractive force is generated in the conveyor belt 31.

The conveying roller 32, the driving roller 34, and the pressure roller 35 support the conveyor belt 31 while applying a certain tension to the conveyor belt 31. The driving roller 34 is linked with the aforementioned conveying motor. On the other hand, the pressing roller 33 defining a pressing unit for pressing the sheet P against the conveyor belt 31 is biased towards the top surface of the conveyor belt 31 by a bias unit (not shown).

The sheet P from the paper-feeder unit is conveyed to the conveyor belt 31 via the conveying roller 32 and the pressing roller 33 so as to be pressed against the conveyor belt 31. In response to the voltage applied by the charging brushes 52, the attraction-generating unit 36 generates an electric force, by which the sheet P is attracted to the flat portion of the conveyor belt 31. By driving the driving roller 34 with the conveying motor, the sheet P attracted to the conveyor belt 31 is conveyed in a direction indicated by an arrow in FIGS. 2 and 4. The sheet P is thus guided to the recording head assembly 7 so that a recording process is performed on the sheet P by the recording heads 7K, 7C, 7M, and 7Y. Subsequently, the electric charge on the conveyor belt 31 is removed by the charge-removing brushes 53 at a position where the sheet P is separated from the conveyor belt 31.

Referring to FIGS. 2 to 6, the attraction-generating unit 36 for attracting the sheet P to the conveyor belt 31 is provided in the conveyor belt 31. The attraction-generating unit 36 includes the positive electrodes 36*a* and the negative electrodes 36*b*, which are formed of conductive metal plates extending crosswise to the conveying direction. These electrodes 36*a*, 36*b* are embedded in the conveyor belt 31. Specifically, the electrodes 36*a* and 36*b* are arranged alternately at a predetermined interval in the conveying direction so as to form a comb-like structure. In the drawings, the electrodes 36*a* and 36*b* extend substantially perpendicular to the conveying direction and are arranged alternately at a predetermined interval in a positive-negative-positive fashion.

Referring to FIG. 2, a first end of each positive electrode 36*a* is provided with an electrified portion 36*a*', and a first end of each negative electrode 36*b* is provided with an electrified portion 36*b*'. The charging brushes 52, 52 functioning as the electrifying unit disposed along the opposite edges of the conveyor belt 31 apply positive and negative voltages respectively to the positive and negative electrodes 36*a*, 36*b* via the electrified portions 36*a*', 36*b*' so that an electrostatic attractive force is generated with respect to the sheet P. Thus, the sheet P is conveyed to the recording head assembly 7 while being held securely by the conveyor belt 31 by the attractive force. The recording head assembly 7 then forms an image on the sheet P being conveyed.

Referring to FIGS. 2 to 6, the patterns of the electrified portions 36*a*' and 36*b*' respectively provided at the first ends of the positive electrodes 36*a* and the first ends of the negative electrodes 36*b* are exposed on the top surface of the conveyor belt 31 along the opposite edges thereof. As described above, the electrodes 36*a* and 36*b* are arranged alternately at a predetermined interval in the conveying direction. The electrified portions 36*a*' of the positive electrodes 36*a* are provided on the upper side in FIG. 2 with respect to the conveying direction, such that the electrified portions 36*a*' of the positive electrodes 36*a* can contact with the conductive charging brush 52 and the charge-removing brush 53 on the upper side with a predetermined pressure. On the other hand, the electrified portions 36*b*' of the negative electrodes 36*b* are provided on the lower side in FIG. 2 with respect to the conveying direction, such that the electrified portions 36*b*' can contact with the conductive charging brush 52 and charge-removing brush 53 on the lower side with a predetermined pressure.

As mentioned above, the charging brushes 52, 52 are connected to the high-voltage power source (not shown). Via the charging brushes 52, 52, the high-voltage power source applies positive voltage to the electrified portions 36*a*' of the positive electrodes 36*a* and negative voltage to the electrified portions 36*b*' of the negative electrodes 36*b*. Referring to FIGS. 4 and 5, the positive electrodes 36*a* and the negative electrodes 36*b* included in the attraction-generating unit 36 are protected by a base layer 36*c* and a top layer 36*d* by being sandwiched therebetween. The base layer 36*c* and the top layer 36*d* can be composed of a synthetic resin, such as polyethylene and polycarbonate.

Referring to FIGS. 1 to 6, the platen 10 includes the belt attraction unit for attracting the conveyor belt 31 to the platen 10 by suction in a sliding manner. The platen 10 functions as a guide member for supporting the conveyor belt 31 in a planar fashion from a side opposite to the recording head assembly 7. A slide-supporting face of the platen 10 is parallel to the discharge face of the recording head assembly 7. Furthermore, the platen 10 can be composed of an electrically conductive material having sufficient suction force with respect to the conveyor belt 31. The slide-supporting face of the platen 10 slidably supports the conveyor belt 31 by suction and is a flat surface with a predetermined width.

The slide-supporting face of the platen 10 is formed of a low-friction material having a thickness of about 100 μm and a coefficient of friction of about 0.2, which may be, for example, a Teflon® film or a polyethylene film of high molecular weight. Accordingly, this contributes to reducing friction between the bottom surface of the conveyor belt 31 and the slide-supporting face of the platen 10 and to a stable driving load during driving of the conveyor belt 31, whereby a high-accuracy conveying function is achieved.

Furthermore, when the sheet P is being conveyed in this exemplary embodiment, a high voltage of, for example, about 0.5 kV to 10 kV is applied to the conveyor belt 31 having the comb-like electrodes 36*a*, 36*b*. This generates an electric force (electrostatic attractive force) in the conveyor belt 31. Due to the electric force, the sheet P attaches to the top surface of the conveyor belt 31. At the same time, due to the suction force of the platen 10, the bottom surface of the conveyor belt 31 attaches the top surface of the platen 10 so that the conveyor belt 31 is restricted from moving in the vertical direction. Accordingly, this achieves a stable conveying operation of the sheet P.

If the conveyor belt 31 and the platen 10 are modeled as shown in FIG. 6, the conveyor belt 31 and the platen 10 can be regarded as capacitors connected in series. Therefore, a suction force F between the positive electrodes 36*a* and the platen 10 can be expressed as follows:

$$F=(\epsilon S/2d^2)\cdot(V-V1-V2)^2 \qquad \text{Equation (1),}$$

where V represents a high voltage applied to the conveyor belt 31, V1 represents a divisional voltage applied to the base layer 36*c* of the conveyor belt 31, V2 represents a divisional voltage applied to a low-friction layer (top layer) 37*c* of the platen 10, ϵ represents a dielectric constant of space between the base layer 36*c* of the conveyor belt 31 and the low-friction layer 37*c* of the platen 10, S represents the surface area of the top surface of the platen 10, and d represents the distance between the positive electrodes 36*a* and the platen 10.

According to Equation (1), the suction force F acting on the conveyor belt 31 is inversely proportional to the square of the distance d between the positive electrodes 36*a* and the platen 10, or more specifically, to the square of the total thickness of the base layer 36*c* and the low-friction layer 37*c*. On the other hand, the suction force F is proportional to the width (surface area) of the top surface of the platen 10, and is also proportional to the square of a voltage value (i.e. the voltage applied to the space) obtained by subtracting the divisional voltage of the base layer 36*c* and the divisional voltage of the low-friction layer 37*c* from the applied high voltage. As long as an upward repulsive force acting on the conveyor belt 31 in its conveying mode is lower than the suction force F, the conveyor belt 31 is constantly attracted to the platen 10. An upward repulsive force is a resultant force of, for example, a shape restoring force and flapping of the conveyor belt 31 during the conveying operation and acts in a direction away from the platen 10.

When a large amount of ink is discharged onto the sheet P, the sheet P may generally swell to form undulated portions. In this exemplary embodiment, the sheet P is prevented from swelling towards the recording head assembly 7 since the sheet P is attracted to the top surface of the conveyor belt 31 by the attraction-generating unit 36. Therefore, even when the recording head assembly 7 is a line type, the recording heads 7K, 7C, 7M, and 7Y and the sheet P are prevented from coming into contact with each other, thereby achieving stable, high-quality recording. Furthermore, even if the undulated portions were to form on the conveyor belt 31, these portions are only allowed to form dispersedly in areas of the conveyor belt 31 where the attractive force is the lowest (i.e. areas between the positive electrodes 36*a* and the negative electrodes 36*b* where conductive metal plates do not exist), whereby the swelling of the sheet P towards the recording head assembly 7 can be reduced to the minimum.

Furthermore, if the edges of the sheet P become corrugated or curled due to a change in the environment, such as temperature and humidity, the pressing roller 33 will fix the corrugated or curled edges by pressing the sheet P against the conveyor belt 31. Because the sheet P is conveyed to the recording head assembly 7 while being attached to the conveyor belt 31 by attraction, a stable sheet conveying operation and a stable image recording operation can both be achieved at the same time.

As described above, referring to FIGS. 1 to 3, the conveyor belt 31 is wound around the driving roller 34, the conveying roller 32 functioning as the driven roller, and the pressure roller 35 functioning as the tension roller. The conveyor belt 31 is driven by the driving roller 34. The conveying roller 32 and the driving roller 34 are attached rotatably to the frame 30 of the sheet conveyor. The pressure roller 35 is rotatably attached to one end of the arm 50, and the other end of the arm 50 is rockably attached to the frame 30. Due to the pressure of the spring 51 received by the arm 50, the pressure roller 35 applies a predetermined tension to the conveyor belt 31.

The pressing roller 33 disposed downstream of the conveying roller 32 for pressing the sheet P against the conveyor belt 31 is biased by the bias unit defined by a spring (not shown) so as to be in pressure-contact with the conveyor belt 31. Thus, the conveyed sheet P is nipped between the pressing roller 33 and the conveyor belt 31. Moreover, the pressing roller 33 is electrically connected to a main frame (not shown) so as to remove the electric charge accumulated in the top layer 36*d* of the conveyor belt 31.

The platen 10 facing the recording head assembly 7 across the conveyor belt 31 has the slide-supporting face which has a surface area that covers the entire recording region of the recording head assembly 7. As described above, the platen 10 can be composed of an electrically conductive material. The slide-supporting face of the platen 10 is formed of a low-friction material having a thickness of about 100 μm and a coefficient of friction of about 0.2, which may be, for example, a Teflon® film or a polyethylene film of high molecular weight. Due to the low-friction material, the friction between the conveyor belt 31 and the platen 10 is reduced, and the driving load during driving of the conveyor belt 31 is stabilized, whereby a high-accuracy conveying function is achieved. Furthermore, the flatness accuracy of the conveyor belt 31 can be maintained at about 0.1 mm or less.

Figure 7:
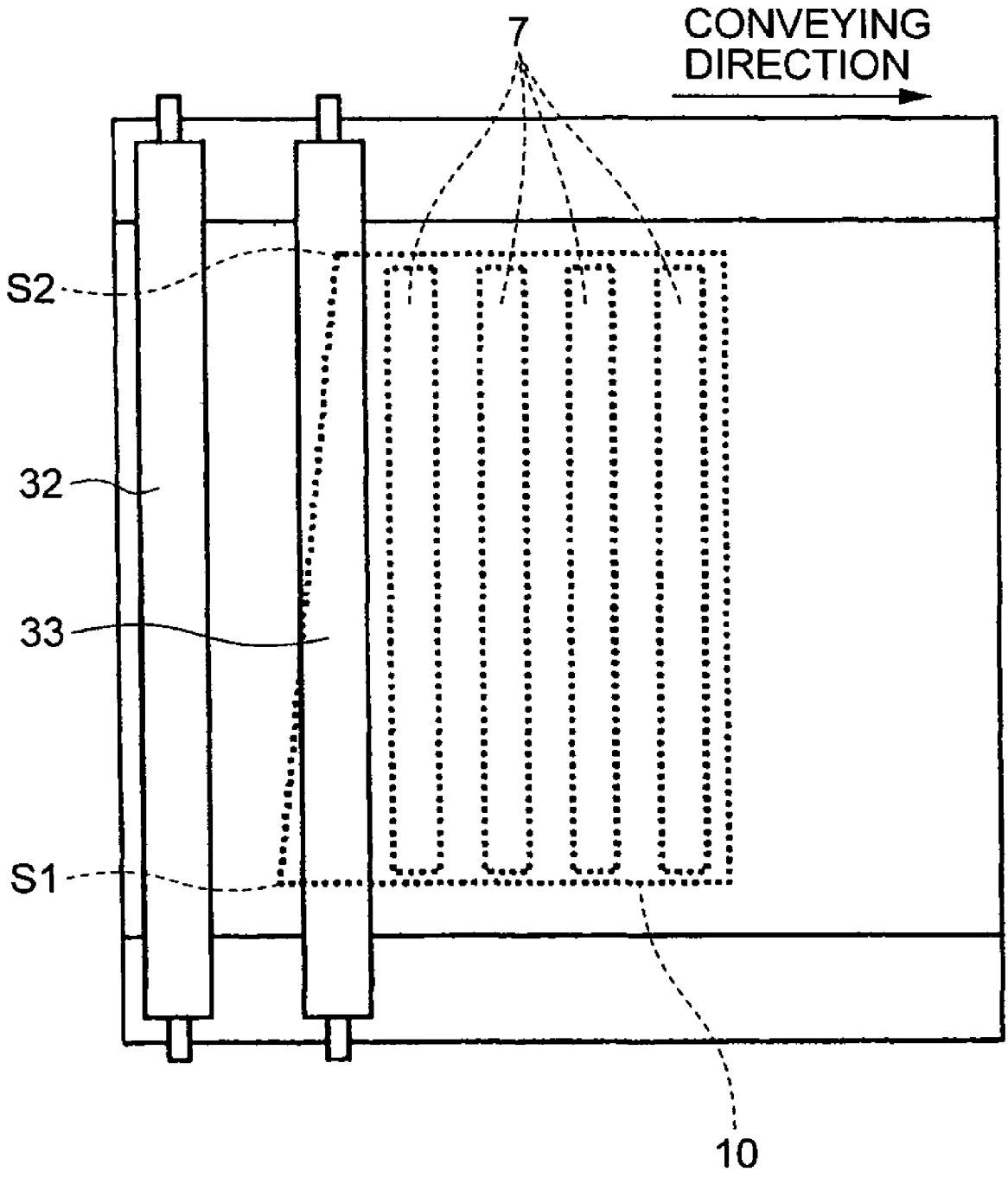
FIG. 7 is a plan view illustrating a relevant portion of a sheet conveyor according to a first embodiment of the present invention.

FIG. 7 is a plan view illustrating a relevant portion of a sheet conveyor according to a first embodiment of the present invention. In FIG. 7, the pressing roller 33 is disposed substantially perpendicular to the conveying direction of the conveyor belt 31 so as to be substantially in parallel to the conveying roller 32. An upstream side of the platen 10 in the conveying direction is inclined by a predetermined angle instead of extending perpendicular to the conveying direction.

In detail, the upstream side of the platen 10 has a shape such that the surface of the platen 10 that comes into contact with the conveyor belt 31 has a width that increases gradually towards the downstream side of the platen 10. In other words, a section of the platen 10 near the upstream side has a shape such that the surface of the platen 10 adjacent to the sheet P has a surface area per unit length in the conveying direction that becomes greater in the downstream direction.

The upstream side of the platen 10 may be inclined by an angle of about 5° to 20°. The inclination direction of the upstream side of the platen 10 may be opposite to the direction shown in FIG. 7. Other than the above-referenced points, the sheet conveyor according to the first embodiment has substantially the same structure as the exemplary embodiment shown in FIGS. 1 to 6.

According to the first embodiment shown in FIG. 7, the conveyor belt 31 being moved in response to the conveying operation attaches to the platen 10 progressively from an uppermost-stream edge of the platen 10 (i.e. an uppermost-stream edge S1 of the platen 10 shown in FIG. 7). When a section of the conveyor belt 31 passes over the edge S1 and another upstream edge S2 of the platen 10, the section is entirely attached to the platen 10 by attraction. As a result, air intervening the conveyor belt 31 and the platen 10 is released towards a non-attached section of the conveyor belt 31 (a non-attached section refers to a section of the conveyor belt 31 downstream from the edges S1 to S2 of the platen 10). Consequently, the air intervening the conveyor belt 31 and the platen 10 can be removed or reduced.

Figure 8:
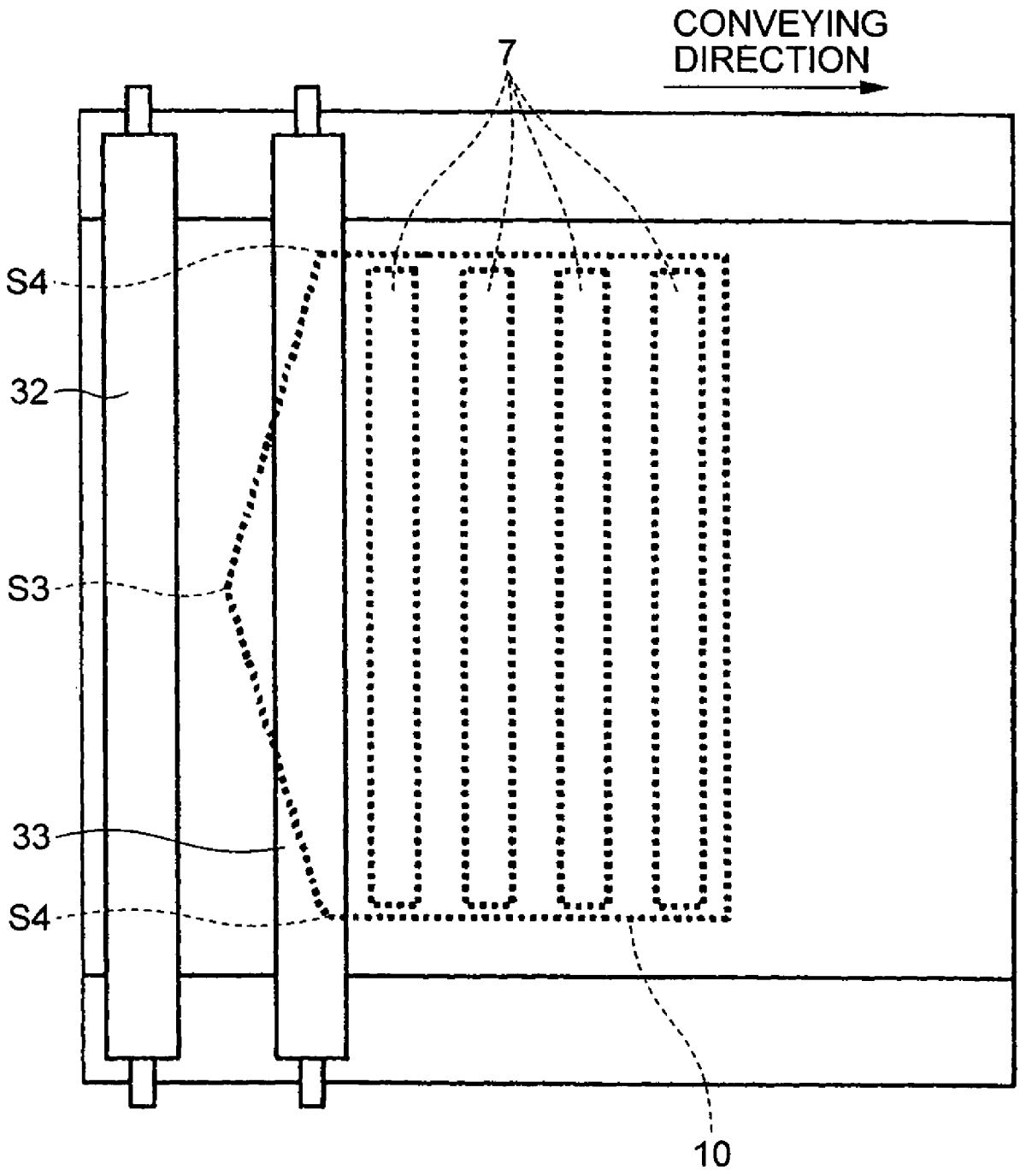
FIG. 8 is a plan view illustrating a relevant portion of a sheet conveyor according to a second embodiment of the present invention.

FIG. 8 is a plan view illustrating a relevant portion of a sheet conveyor according to a second embodiment of the present invention. In FIG. 8, the upstream side of the platen 10 has a projected central portion in the width direction, such that the projected central portion defines the uppermost-stream edge of the platen 10. The upstream side of the platen 10 is inclined by a predetermined angle from the central portion towards opposite edges of the platen 10. The predetermined inclination angle may be set within a range of, for example, 5° to 20°. In association with this shape of the upstream side of the platen 10, the electrodes 36*a*, 36*b* of the attraction-generating unit 36 provided in the conveyor belt 31 are given substantially the same shape and are arranged at substantially the same inclination angle. Moreover, the charging brushes 52 for high-voltage application and the charge-removing brushes 53 for charge removal are arranged so as to correspond to the arranged pattern of the electrodes 36*a*, 36*b*.

In FIG. 8, the pressing roller 33 is disposed substantially perpendicular to the conveying direction of the conveyor belt 31. Other than the above-referenced points, the sheet conveyor according to the second embodiment has substantially the same structure as the exemplary embodiment shown in FIGS. 1 to 6. According to the second embodiment, the conveyor belt 31 being moved in response to the conveying operation attaches to the platen 10 progressively from the uppermost-stream edge of the platen 10 defined by the central portion (i.e. a central upstream edge S3 of the platen 10 shown in FIG. 8). When a section of the conveyor belt 31 passes over upstream side edges S4, S4 of the platen 10, the section is entirely attached to the platen 10 by attraction. As a result, air intervening the conveyor belt 31 and the platen 10 is released towards a non-attached section of the conveyor belt 31 (a non-attached section refers to a section of the conveyor belt 31 downstream from the upstream side edges S4, S4 of the platen 10). Consequently, the air intervening the conveyor belt 31 and the platen 10 can be removed or reduced.

Figure 9:
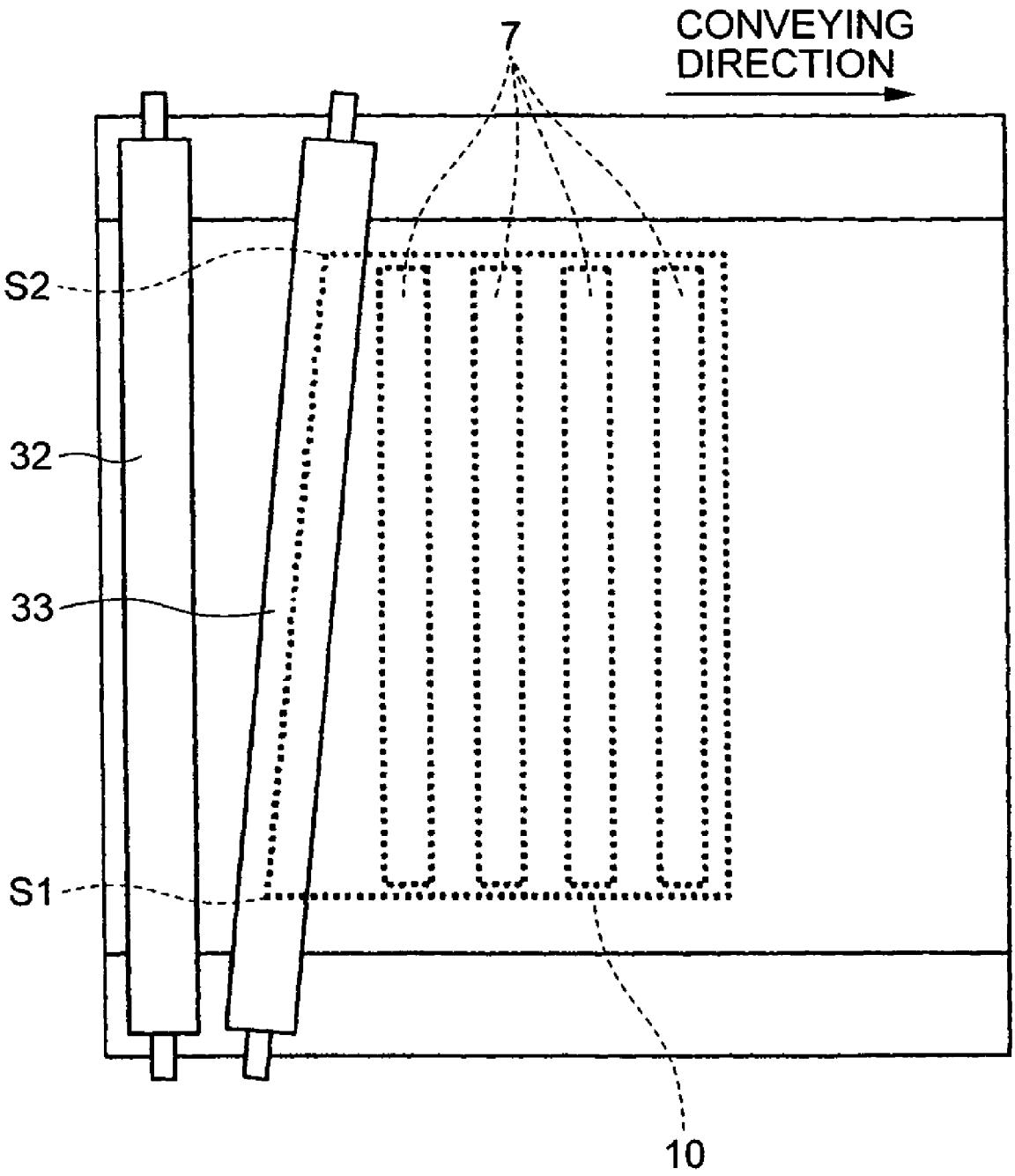
FIG. 9 is a plan view illustrating a relevant portion of a sheet conveyor according to a third embodiment of the present invention.

FIG. 9 is a plan view illustrating a relevant portion of a sheet conveyor according to a third embodiment of the present invention. Similar to the first embodiment shown in FIG. 7, the upstream side of the platen 10 in the third embodiment shown in FIG. 9 is inclined by a predetermined angle instead of extending perpendicular to the conveying direction. As in the first embodiment, the predetermined inclination angle may be set within a range of about 5° to 20°. According to the third embodiment, the pressing roller 33 does not extend perpendicular to the conveying direction. Instead, the pressing roller 33 extends along the upstream side of the platen 10, meaning that the pressing roller 33 is inclined by substantially the same inclination angle as the upstream side. Other than the above-referenced points, the sheet conveyor according to the third embodiment has substantially the same structure as the exemplary embodiment shown in FIGS. 1 to 6.

Similar to the first embodiment shown in FIG. 7, according to the third embodiment shown in FIG. 9, the conveyor belt 31 being moved in response to the conveying operation attaches to the platen 10 progressively from the uppermost-stream edge towards the downstream side thereof. When a section of the conveyor belt 31 passes over the edges S1 and S2 of the platen 10, the section is entirely attached to the platen 10 by attraction. As a result, air intervening the conveyor belt 31 and the platen 10 is released towards the non-attached section of the conveyor belt 31. Consequently, the air intervening the conveyor belt 31 and the platen 10 can be removed or reduced.

Figure 10:
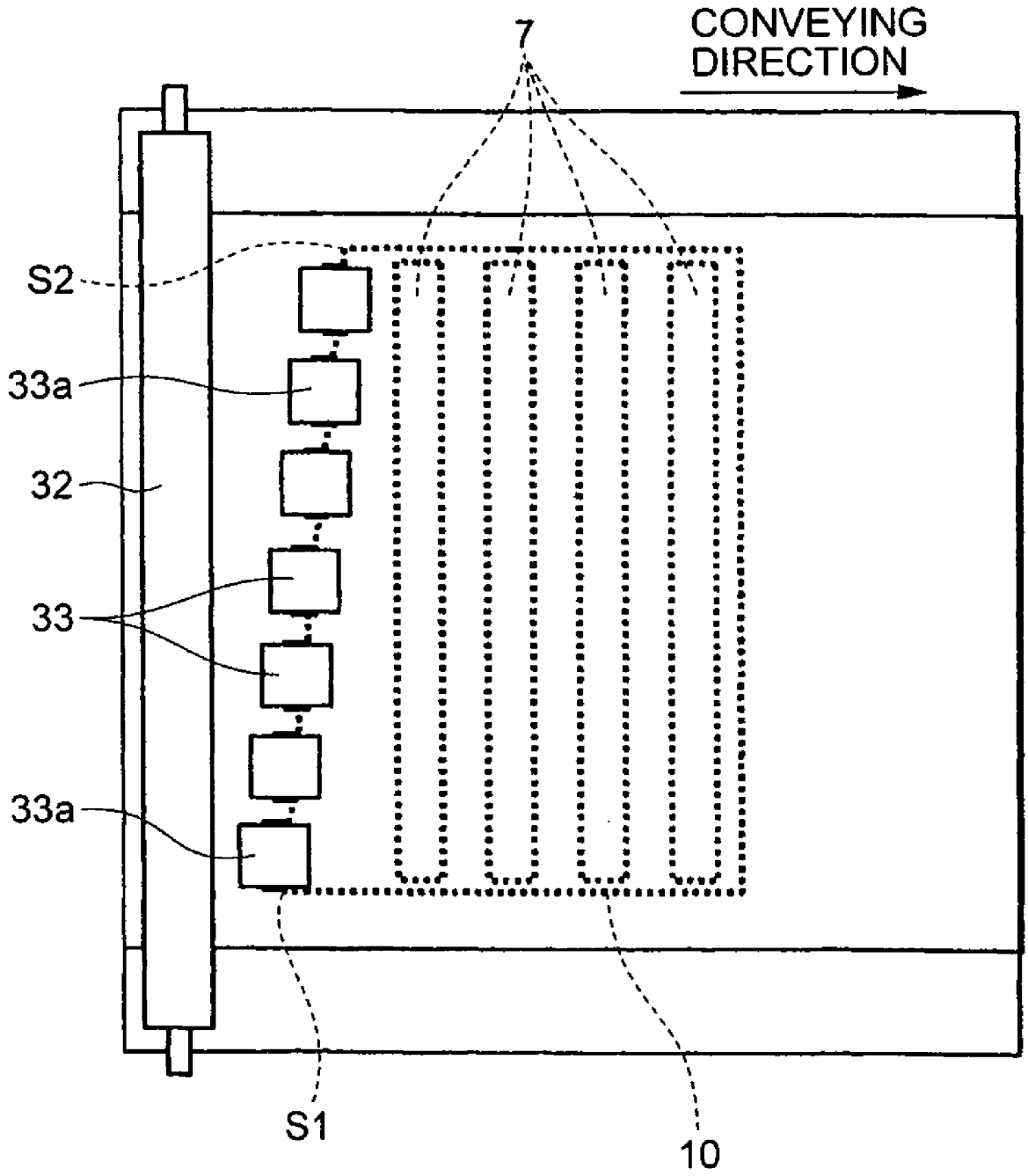
FIG. 10 is a plan view illustrating a relevant portion of a modification example of the third embodiment shown in FIG. 9.
Figure 11:
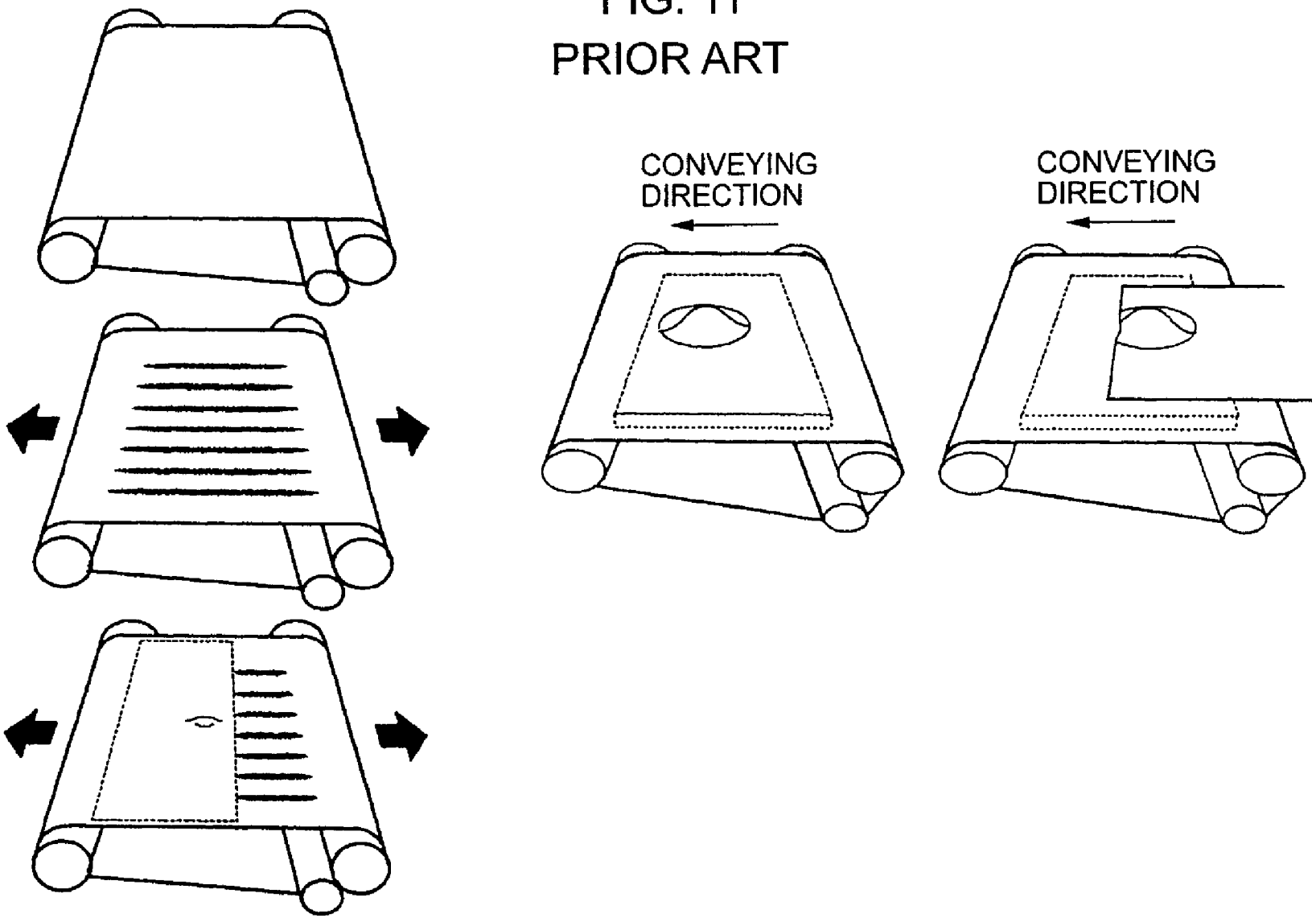
FIG. 11 PRIOR ART
FIG. 11 schematically illustrates the disadvantages in a sheet conveyor having a conveyor belt of related art.

FIG. 10 is a plan view illustrating a relevant portion of a modification example of the third embodiment shown in FIG. 9. In the third embodiment shown in FIG. 9, the inclination angle of the upstream side of the platen 10 is large, thus creating a large positional difference between the opposite edges S1, S2 of the platen 10 in the conveying direction. Since the pressing roller 33 is disposed at the same inclination angle as the upstream side of the platen 10 in the third embodiment shown in FIG. 9, the direction of the sheet P conveyed through the pressing roller 33 becomes inclined at the same angle with respect to the moving direction of the conveyor belt 31. In some cases, slipping can be induced between the conveyor belt 31 and the pressing roller 33, thus creating a state where the surfaces of the sheet P are rubbed therebetween. This could possibly cause the belt attraction to become unstable. The modification example shown in FIG. 10 prevents this by providing the pressing roller 33 with a plurality of pressing-roller segments 33*a*.

In FIG. 10, the pressing roller 33 disposed along the upstream side of the platen 10 is divided into the plurality of pressing-roller segments 33*a*. Each pressing-roller segment 33*a* is rotatable in the same direction as the conveying direction. Other than the above-referenced difference from the third embodiment shown in FIG. 9, the modification example shown in FIG. 10 has substantially the same structure as the third embodiment. According to this modification example, even if the inclination angle of the upstream side of the platen 10 were made even larger, any slipping between the conveyor belt 31 and the pressing roller 33 can be prevented, thereby effectively achieving stable attraction of the conveyor belt 31 to the platen 10.

According to the above embodiments, the upstream side of the platen 10 is given a shape such that the sliding area between the conveyor belt 31 and the platen 10 becomes larger gradually in the moving direction of the conveyor belt 31. Accordingly, the conveyor belt 31 can be properly attached to the platen 10 by attraction without having air in between. Thus, the flatness accuracy of a predetermined surface area of the conveyor belt 31 is properly maintained so that the sheet P is conveyed with high accuracy. Accordingly, the present invention provides a sheet conveyor and an image formation device that achieve a reduced distance between the sheet P and the recording head assembly 7 for high-resolution image formation.

With the recent development of high-density packaging of recording heads for achieving higher recording speed and higher resolution, an ability to maintain a sheet material flat over a wide region, including the recording region, during conveying of the sheet material is required in a platen which supports the conveyor belt and the sheet material in the recording region. Such ability required in the platen is successfully achieved in the present invention. Thus, the conveying operation of the sheet material can be performed with high accuracy while the distance between the recording medium and the recording head assembly is maintained at a small fixed value, whereby high-resolution images can be attained. The present invention is especially effective when applied to an image formation device in which the image quality is directly affected by the abovementioned flat-maintaining ability. An example of such an image formation device is a single-pass high-speed recording device equipped with a line-type recording head.

The above embodiments are directed to an image formation device including a line-type image-forming unit defined by, for example, a full-line recording head assembly. Alternatively, the present invention is similarly applicable to other recording-type image formation devices, such as a serial-type image formation device including an image-forming unit that moves in a main scanning direction with respect to a sheet material. In such alternative devices, the present invention achieves the same advantages as in the above embodiments. Furthermore, although the above embodiments are directed to an image formation device of an inkjet type, the present invention is also applicable to image formation devices of other recording types, such as a thermal transfer type, a thermo-sensitive type, a laser-beam emission type, and a wire-dot type. In such alternative devices, the present invention achieves the same advantages as in the above embodiments.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-143542 filed May 17, 2005, which is hereby incorporated by reference herein in its entirety.

What is claimed is:

1. A sheet conveyor comprising:

a conveyor belt that conveys a sheet material while holding the sheet material by attraction with an electric force; and a platen slidably supporting a bottom surface of the conveyor belt so as to maintain flatness of a predetermined region of the conveyor belt, wherein the upstream side of the platen is inclined at a non-zero predetermined angle with respect to a direction perpendicular to a conveying direction of the conveyor belt such that a surface of the platen that is in contact with the conveyor belt has a width that increases gradually from an upstream side of the platen towards a downstream side thereof in a conveying direction of the conveyor belt.

2. The sheet conveyor according to claim 1, wherein the upstream side of the platen includes a central portion in a width direction of the conveyor belt, wherein the central portion is disposed at an uppermost-stream position in the conveying direction, and wherein the upstream side is inclined from the central portion towards opposite edges of the platen in a downstream direction.

3. The sheet conveyor according to claim 1, further comprising a pressing roller that presses the conveyor belt against the platen, the pressing roller being disposed at a position facing the upstream side of the platen across the conveyor belt.

4. The sheet conveyor according to claim 3, wherein the pressing roller is inclined substantially similar to the upstream side of the platen.

5. The sheet conveyor according to claim 4, wherein the pressing roller comprises a plurality of pressing-roller segments.

6. The sheet conveyor according to claim 1, wherein the conveyor belt includes a plurality of electrodes which are arranged at a predetermined interval in the conveying direction to form a comb-like structure, and wherein a voltage is applied to the electrodes so as to generate an attractive force for attracting the sheet material to the conveyor belt.

7. An image formation device comprising:

an image-forming unit that forms an image on a sheet material on the basis of image information; and the sheet conveyor according to claim 1.

8. The image formation device according to claim 7, wherein the image-forming unit is disposed at a position facing the platen across the conveyor belt.

9. The image formation device according to claim 7, wherein the image-forming unit comprises an inkjet recording head that discharges ink towards the sheet material through discharge nozzles to perform a recording operation.

10. The image formation device according to claim 8, wherein the image-forming unit comprises an inkjet recording head that discharges ink towards the sheet material through discharge nozzles to perform a recording operation.

11. The image formation device according to claim 7, wherein the image-forming unit comprises a line-type recording head extending crosswise to the conveying direction.

12. A sheet conveyor comprising:

a conveyor belt that conveys a sheet material while holding the sheet material by electrostatic attraction; and a guide member that supports the conveyor belt by being in contact with a surface of the conveyor belt opposite to a surface thereof that holds the sheet material by electrostatic attraction, wherein an upstream side of the guide member is inclined at a non-zero predetermined angle with respect to a direction perpendicular to a conveying direction of the conveyor belt such that a surface of the guide member that is in contact with the conveyor belt has a surface area per unit length in the conveying direction that becomes greater in a downstream direction.

13. An image formation device comprising:

an image-forming unit that can form an image on a sheet material on the basis of image information; and the sheet conveyor according to claim 12.

* * * * *